US006113443A

United States Patent [19]

Eichinger

[11] Patent Number: 6,113,443

[45] Date of Patent: Sep. 5, 2000

[54] TRIM TAB FOR JET PROPULSION SYSTEM

[75] Inventor: Charles H. Eichinger, Oshkosh, Wis.

[73] Assignee: Brunswick Corporation, Lake Forest, Ill.

[21] Appl. No.: 09/307,832

[22] Filed: May 10, 1999

[51] Int. Cl.[7] ..... B63H 11/113

[52] U.S. Cl. ..... 440/42; 440/43

[58] Field of Search ..... 440/40–43, 38

[56] References Cited

U.S. PATENT DOCUMENTS

| | | | |
|---|---|---|---|
| 3,799,103 | 3/1974 | Granholm | 115/34 |
| 3,817,202 | 6/1974 | Holtermann | 115/34 |
| 3,906,885 | 9/1975 | Woodfill | 440/42 |
| 3,943,876 | 3/1976 | Kiekhaefer | 115/12 |
| 3,955,527 | 5/1976 | Holtermann | 115/35 |
| 4,056,073 | 11/1977 | Dashew | 114/151 |
| 4,315,749 | 2/1982 | Baker | 440/42 |
| 4,509,924 | 4/1985 | Hall | 440/51 |
| 4,693,689 | 9/1987 | Harada | 440/51 |
| 4,908,766 | 3/1990 | Takeuchi | 364/448 |
| 4,917,637 | 4/1990 | Soga et al. | 440/43 |
| 5,154,650 | 10/1992 | Nakase | 440/41 |
| 5,277,631 | 1/1994 | henmi | 440/47 |
| 5,752,864 | 5/1998 | Jones | 440/41 |
| 5,755,601 | 5/1998 | Jones | 440/1 |

FOREIGN PATENT DOCUMENTS

| | | | |
|---|---|---|---|
| 3-21587 | 1/1991 | Japan | 440/42 |

*Primary Examiner*—Sherman Basinger
*Attorney, Agent, or Firm*—William D. Lanyi

[57] ABSTRACT

A trim tab is provided in the internal portion of a nozzle of a jet propulsion system. The trim tab can be rotating about an axis to expose a surface of the trim tab to the jet stream of water passing through the nozzles of the jet propulsion system. The exposure of one of the trim tab surfaces creates a thrust vector in either the port or starboard direction which creates a corrective thrust, in a desired direction, which overcomes any manufacturing misalignments.

11 Claims, 5 Drawing Sheets

TRIM TAB FOR JET PROPULSION SYSTEM

BACKGROUND OF THE INVENTION

1. Field of the Invention

The present invention is generally related to a trim tab for use in a jet propulsion system and, more particularly, to a trim tab that is attached to the inner cylindrical surface of a nozzle of the jet propulsion system.

2. Description of the Prior Art

Trim tabs have been known for use in outboard motor and stern drive types of marine propulsion systems for many years. The primary function of a trim tab is to provide a minor adjustment to the steering alignment of a marine propulsion system which is intended to eliminate lateral forces on a watercraft during normal operation.

U.S. Pat. No. 3,955,527 which issued to Holtermann on May 11, 1976, describes a marine propulsion trim tab with an anti-ventilation device. A marine propulsion device includes a lower unit that comprises a laterally extending anti-cavitation plate extending from the lower unit above a propeller and including a trailing portion, together with a trim tab extending downwardly from the trailing portion of the anti-cavitation plate aft of the propeller. It also comprises a deflector that is located aft of the propeller and extending from the trailing portion from the anti-cavitation plate and rearwardly of the trim tab for pressurizing the water forward thereof and below the anti-cavitation plate and in the region of the trim tab during forward movement of the lower unit through the water.

U.S. Pat. No. 3,817,202 which issued to Holtermann on Jun. 18, 1974, describes an anti-ventilation fence for a trim tab. A stern drive unit includes a trim tab extending from a driveshaft housing behind a propeller and downwardly into an imaginary cylinder projecting rearwardly in concentric relation to the propeller axis from the top of the tip of the propeller, and a generally horizontally projecting barrier extending from the trim tab and located below the intersection of the imaginary cylinder and the trim tab.

U.S. Pat. No. 3,799,103, which issued to Granholm on Mar. 26, 1974, describes a stern drive unit trim tab. The stern drive lower unit comprises a lower portion which is at least partially submerged during normal operation and which includes a rotatably mounted propeller shaft carrying a propeller, and a trim tab which is located rearwardly and above the propeller and which includes two side surfaces, one of which is subject to thrust or impact by water propelled by the propeller and is provided with a forward portion and a rearward portion offset from the forward portion in the direction toward the other of the side surfaces.

U.S. Pat. No. 4,908,766, which issued to Takeuchi on Mar. 13, 1990, describes a trim tab actuator for an propulsion device. The improved trim tab actuator for a watercraft is intended for use in permitting the operator to automatically select any of a plurality of steering effects by automatic control of the trim tab. The trim tab is positioned in response to sense steering and watercraft conditions and the operator may also select any of a plurality of modes mapped in response to these conditions.

U.S. Pat. No. 4,509,924, which issued to Hall on Apr. 9, 1985, describes a control system for a torque correcting device. The invention provides a marine propulsion device comprising a propulsion unit, a transom bracket adapted to be fixedly connected to a boat transom and a swivel bracket mounted on the transom bracket for pivotal movement about an axis which is horizontal when the transom bracket is boat mounted. The marine propulsion device also includes a king pin assembly mounted on the swivel bracket for pivotal steering movement of the propulsion unit and a mounting mechanism for mounting the propulsion unit on the king pin assembly and permitting limited rotational movement of the propulsion unit relative to the king pin assembly. The marine propulsion device also includes a trim tab mounted on the propulsion unit for pivotal movement about an axis transverse to the horizontal axis, and a linkage mechanism for displacing the trim tab about the transverse axis in response to rotational movement of the propulsion unit relative to the king pin assembly.

U.S. Pat. No. 4,693,689, which issued to Harada on Sep. 15, 1987, describes a controlling gear for an outboard engine. The outboard motor embodying an improved throttle and trim tab control mechanism comprised a trim tab which is pivotally supported by the outboard motor for assisting in its steering operation. The trim tab is operated by means of a pair of flexible transmitters that are fixed, at their upper ends, to extend in a generally longitudinal direction and which are operated from a drum by means of lost motion connection that is operative in response to movement of the steering lever relative to the outboard motor. The steering lever is further supported for rotation and is operatively connected to the engine throttle for controlling its operation in response to rotation of the control lever.

U.S. Pat. No. 3,943,876, which issued to Kiekhaefer on Mar. 16, 1976, discloses a water jet boat drive that is mounted rigidly entirely outboard of the boat and driven from an inboard engine by an interconnected shaft through the transom. The tail nozzle is mounted concentric of and spaced from the pump chamber of the jet and extends rearwardly therefrom axially thereof. A butterfly trim vane is pivotally mounted on a transverse horizontal axis in the tail nozzle and is adapted to close the nozzle for blocking the jet and compelling a reverse flow of the water from the pump through the passages between the pump chamber and tail nozzle. A steering vane is mounted on a vertical axis rearwardly of the tail nozzle and carries a rudder disposed beneath the jet steering vane for steering during reversal of the jet. The engine exhaust is introduced to the jet stream within the tail nozzle and has a by-pass operable during reverse of the jet stream.

U.S. Pat. No. 4,056,073, which issued to Dashew et al on Nov. 1, 1977, describes a boat thruster that includes a diverter valve with an inlet connected to a water pump, a pair of outlets extending to either side of the boat, a valve mechanism for accurately controlling the amount of thrust obtained from both outlets, and a deflector positioned at each outlet. Each deflector is movable between a first position wherein it allows a sideward water discharge to thrust the bow to the side, and a second position wherein it directs water rearwardly to move the boat in a forward direction, or if required, to a third position to move the boat rearwardly.

U.S. Pat. No. 5,154,650, which issued to Nakase on Oct. 13, 1992, describes a water jet propulsion unit for a small watercraft that incorporates a mechanism for actuating the reverse thrust bucket through an intermediate lever so as to permit a flexible cable to be employed that lies closely above the jet propulsion unit. The actuating device is constructed so as to provide self-locking of the reverse thrust bucket in at least one of its positions. Various linkage arrangements for achieving the interrelationship are disclosed.

U.S. Pat. No. 5,755,601, which issued to Jones on May 26, 1998, discloses a brake system for a personal watercraft. The watercraft has a brake which the driver of the watercraft can use to decelerate forward motion of the watercraft. The brake mechanism preferably includes a reverse gate that allows watercraft steering to be consistent when the watercraft is accelerating or cruising with a reverse gate in a full-up position as when the watercraft is decelerating with the reverse gate in a full-down or partial-down position. The positioning of the reverse gate during the operation of the watercraft is adjusted in accordance with the state of hand operated actuators for a forward throttle control mechanism and a brake control mechanism. Preferably, an electronic controller receives a signal from the control mechanisms and outputs a control signal that directs a servomotor to move a reverse gate control cable or linkage to position the reverse gate. Forward thrust can be increased by proportionally closing the actuator for the forward thrust control mechanism. In addition, reverse thrust or braking thrust can be increased by proportionally closing the actuator for the brake control mechanism.

U.S. Pat. No. 4,315,749, which issued to Baker et al on Feb. 16, 1982, describes a non-jamming reversible jet nozzle. The reversible hydrojet boat drive for the substantially nonturbulent nozzling of water during the forward mode is disclosed and effective non-jamming seal function during the reverse mode is included. It comprises an exact nozzle continuation of the exit passage of the pump, particularly the top wall thereof, and the compatible eccentric relation of the surrounding seals of the reverse gate centered below the axis of gate rotation, thereby avoiding jamming and elevating strain on the control system.

U.S. Pat. No. 5,752,864, which issued to Jones et al on May 19, 1998, discloses a reverse gate for a personal watercraft. The reverse mechanism includes a reverse gate that provides low restriction to the flow of water through the jet pump and also provides significant steering characteristics. The reverse gate has a deflector surface with a vertical jet divide that divides the deflector surface. Both sides of the deflector surface are in the form of a simple curve. In the preferred embodiment, the simply curved deflector surfaces slant inward towards a central apex which serves as the vertical jet divide. The deflector surface spans between a starboard side support structure and a port side support structure which are pivotally mounted along a horizontal axis so that the reverse gate can be moved between a full-up position and a full-down position rearward of the jet pump. Both the starboard side support structure and the port side support structure include apertures therethrough which allow a portion of the jet flow to exit laterally from the reverse gate. When the reverse gate is in the fully down position, a portion of the jet flow is redirected forward to provide reverse thrust, and a portion of the jet of water is deflected laterally to port and laterally to starboard proportionally in accordance with the direction of the jet pump rudder.

U.S. Pat. No. 5,277,631, which issued to Henmi on Jan. 11, 1994, describes a vane arrangement for a water jet propulsion assembly. A water jet propulsion assembly for a jet ski-type watercraft includes an annular duct including a first section within which an impeller is located, a second section having a group of sloping vane members extending radially therethrough and a third section formed with a group of straight vane members extending partially radially inwardly from the inside surface of the outermost duct wall. The duct terminates in a nozzle for expelling water flowing therethrough. The second section of the duct includes radially inner and outer wall portions and the inner portion has a cap member secured to a rear end thereof. The cap member extends into the third duct section and is formed with another group of straight vane member which extend radially outwardly. The vane members function to convert the swirling water flow created by the impeller into a linear flow that is directed through the nozzle. The sloping and straight vane members are divided to permit more efficient molding of the vane sections by die casting.

When a jet propulsion system is installed in a watercraft, such as a jet boat, personal watercraft (PWC), or a jet ski, the thrust vector resulting from the ejection of water through the nozzle of the propulsion system, when the steering mechanism is centered, may not always be perfectly parallel to the centerline of the watercraft. Small variations in the manufacturing of the propulsion system and the assembly of the propulsion systems watercraft may result in a slight misalignment between the centerline of the watercraft and the thrust vector when the steering mechanism is in its center position. This will result in a slight pulling, either toward port or starboard, when the operator of the watercraft is attempting to steer the watercraft in a straight line. As a result, the operator must exert a corrective force on the steering mechanism (e.g. the steering wheel or handle bars) in order to maintain a straight course. This effect can result in operator fatigue and, in certain circumstances, create an unsafe condition.

Other factors can cause this type of steering misalignment. For example, certain watercraft exhibit different resistances to air flow on the port and starboard sides of the vessel. In other words, with a steering wheel and console located at the starboard side of the watercraft, wind resistance can cause a force against the driver's console of sufficient magnitude to create a clockwise torque on the watercraft.

Regardless of the specific source of the misalignment, it would be significantly beneficial if a means could be provided which corrects this slight misalignment and allows the operator to drive in a straight ahead course without having to exert a torque on the steering mechanism.

SUMMARY OF THE INVENTION

In a particularly preferred embodiment of the present invention, a jet propulsion system for a watercraft comprises a first nozzle through which water is ejected by an impeller. The first nozzle is generally cylindrical and disposed about a horizontal axis. In a typical application, the first nozzle is rigidly attached to an impeller region of a jet propulsion system and, in effect, is rigidly attached to the watercraft. The jet propulsion system further comprises a second nozzle which is rotatable about a vertical axis through a range of angles relative to the first nozzle. The second nozzle is used for steering purposes and allows an ejected stream of water to be turned toward the port or starboard directions so that an effective force vector can be exerted on the watercraft to allow it to turn in response to the watercraft operator's control of the steering mechanism.

The present invention further comprises an adjustable trim tab that is attached to a preselected one of the first and second nozzles. The trim tab has at least one surface which is disposable in a non-parallel association with the horizontal axis of the first nozzle.

The adjustable trim tab can be attached to the first nozzle and particularly to an internal bottom surface of the first nozzle. Alternatively, the adjustable trim tab can extend vertically upward from an internal bottom surface of the first nozzle to an internal top surface of the first nozzle. The trim tab can also be attached to the second nozzle, either to an internal bottom surface of the second nozzle or extending from an internal bottom surface to an internal top surface of the nozzle.

A particularly preferred embodiment of the present invention provides a threaded stud that is attached to the trim tab, with the stud extending through a hole formed through a wall of the preselected one of the first and second nozzles. Non-parallel association of at least one surface of the trim tab with the horizontal axis of the first nozzle causes a force to be exerted on the preselected one of the first and second nozzles in a direction that is non-parallel to the horizontal axis. The present invention can further comprise a watercraft having a jet propulsion system attached thereto.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
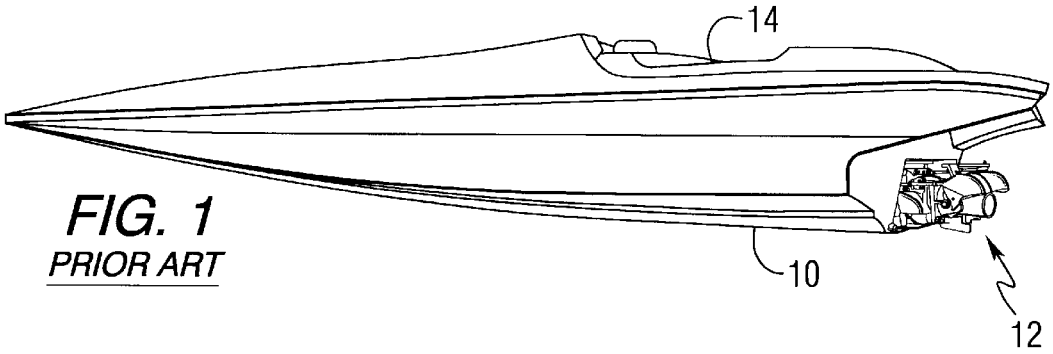
FIG. 1 PRIOR ART
FIG. 1 shows a known type of jet propulsion watercraft.

Throughout the description of the preferred embodiment, like components will be identified by like reference numerals.

FIG. 1 shows a known type of jet boat 10 which is propelled by a jet propulsion system 12. An operator sits in a passenger compartment 14 and, through the use of a steering wheel or other type of steering mechanism, controls the left to right movement of a steering rudder to control the movement of the watercraft 10.

Figure 2:
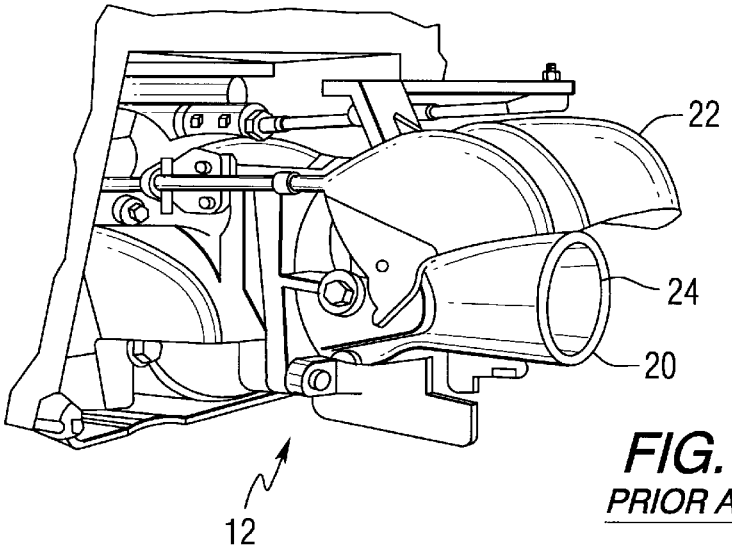
FIG. 2 PRIOR ART
FIGS. 2, 3, and 4 show various types of jet propulsion systems.

FIG. 2 shows an enlarged view of the jet propulsion system 12 which includes a steering nozzle 20 and a flow deflector 22 which can be lowered into position to redirect an ejected stream of water that is emitted from the exit opening 24 of the steering nozzle.

Figure 3:
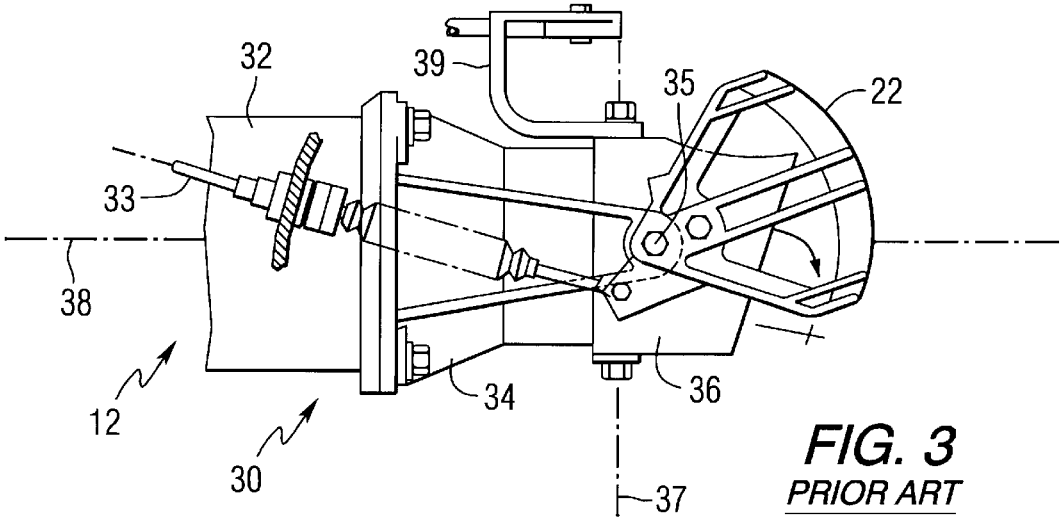
FIG. 3 PRIOR ART

An alternatively configured jet propulsion system 30 is shown in FIG. 3. An impeller is housed within a section 32 of the jet propulsion system. A first nozzle 34 is rigidly attached to the jet propulsion system and to an associated watercraft. A second nozzle 36 is rotatably attached to the first nozzle 34. The second nozzle 36 can be rotated, about axis 37, to allow an operator to steer the watercraft. The vertical axis 37 is generally perpendicular to a horizontal axis 38 which is a central axis of the generally cylindrical first nozzle 34. Water is ejected from the first nozzle 34 in a direction that is parallel to the horizontal axis 38. As the second nozzle 36 is rotated about its vertical axis 37, by a steering mechanism 39, the water passing through the second nozzle 36 is turned in a direction toward port or starboard to allow the operator to steer the vehicle. A flow deflector 22, which is slightly different than the flow deflector 22 in FIG. 2, is operable by a lever mechanism 33 which causes the flow deflector 22 to rotate about a pivot 35.

Figure 4:
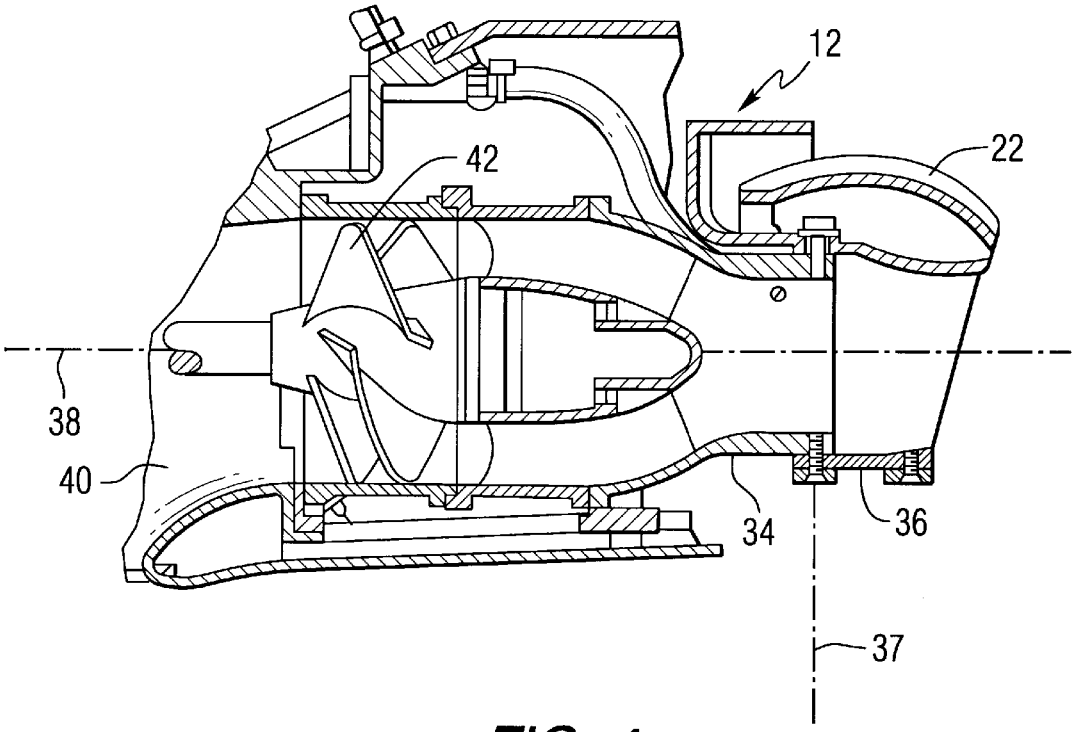
FIG. 4 PRIOR ART

FIG. 4 shows another version of a jet propulsion system. Water is caused to flow through an inlet and through channel 40 by the rotation of impeller blades 42 which rotate about the horizontal axis 38 which is also the central axis of the first nozzle 34. As described above in conjunction with FIG. 3, a second nozzle 36 is rotatable about a vertical axis 37. The rotation of the second nozzle 36 about vertical axis 37 allows the second nozzle 36 to be moved relative to the horizontal centerline 38 of the first nozzle 34 which allows an operator to steer the watercraft in which the jet propulsion system 12 is used.

Figure 5B:
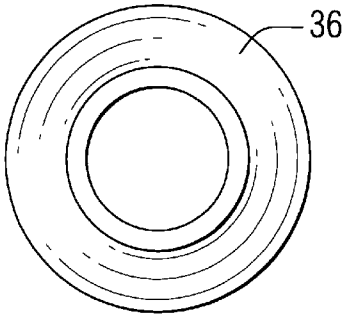
FIG. 5B PRIOR ART
FIGS. 5A and 5A are two views of a known propulsion system shown in a simplified schematic diagram.
Figure 5A:
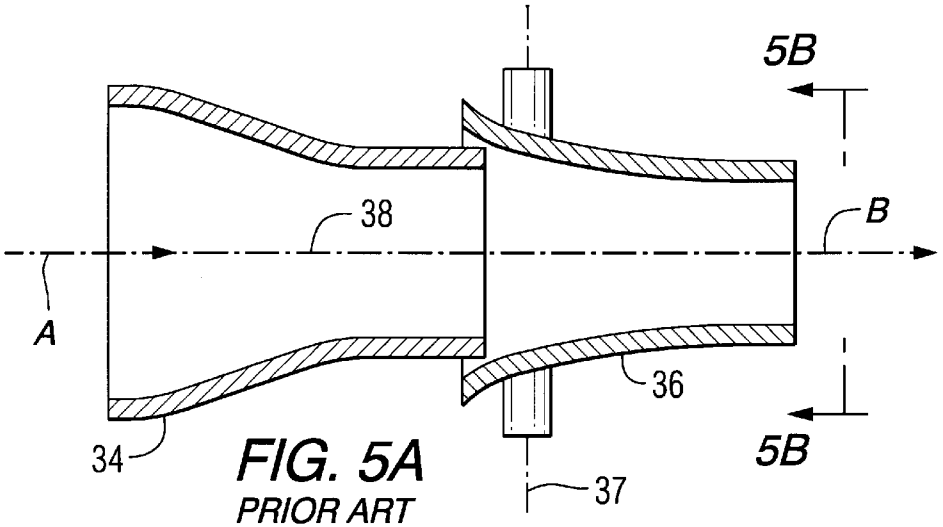
FIG. 5A PRIOR ART

In order to more clearly explain the basic principles of the present invention, the prior art arrangement is drawn, as an arrangement of simplified functional components in FIGS. 5A and 5B. Water is forced, by an impeller, through the first nozzle 34 in the direction represented by arrow A. The water continues to flow from the first nozzle 34 and through the second nozzle 36. Since the second nozzle 36 is rotatable about vertical axis 37, the water can be diverted away from the central axis 38 of the first nozzle 34. This permits an operator to select the direction in which the thrust vector extends from the jet propulsion system. This, in effect, allows the operator to steer the watercraft. FIG. 5B is an end view of the second nozzle 36. Both the first and second nozzles, in typical jet propulsion systems, are generally cylindrical, although they both tend to have several effective diameters. In other words, the upstream end of the first nozzle 34 has a greater diameter than the downstream end of the first nozzle. Similarly, the second nozzle 36, or steering nozzle, also has a larger upstream end than a downstream end in many types of jet propulsion systems. However, in order to more clearly describe the present invention, the nozzles will be described as generally being symmetrical about an axis and, in general, being cylindrical in shape.

Figure 6B:
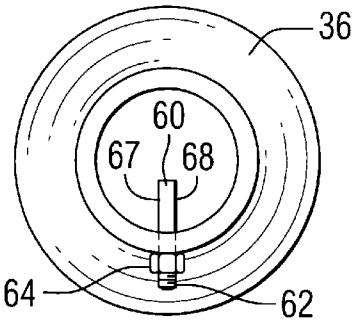
FIGS. 6A and 6B are two views of the present invention.
Figure 6A:
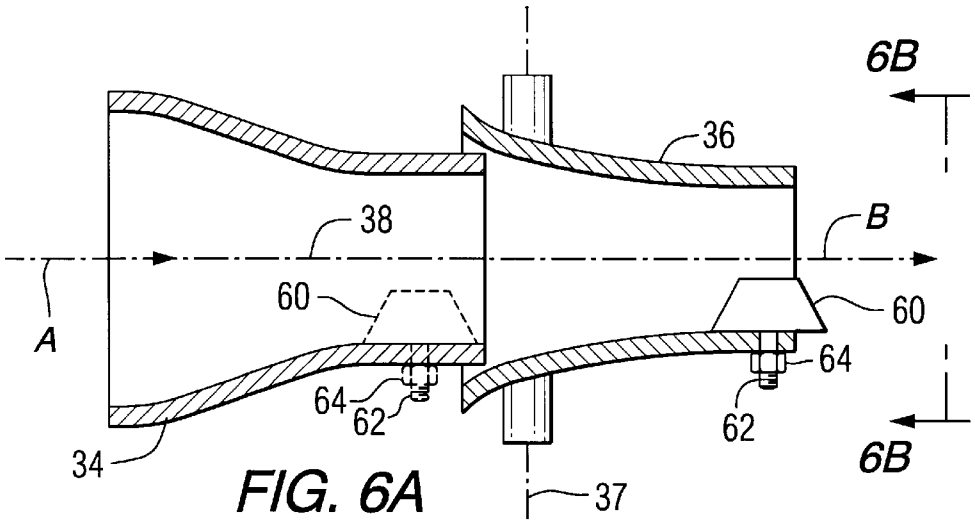

FIG. 6A shows a jet propulsion system made in accordance with the present invention. As can be seen by comparing FIGS. 5A and 6A, the basic structure of the first nozzle 34 and the second nozzle 36 are generally the same as those illustrated in FIG. 5A, but a trim tab 60 is attached to the internal bottom surface of the second nozzle 36. A threaded stud 62 extends from the trim tab 60 and the threaded stud is passed through a hole in the second nozzle 36. A nut 64 is used to rigidly attach the trim tab 60 to the internal surface of the second nozzle 36. Although shown being attached to the second nozzle 36, the trim tab 60 can also be attached to the first nozzle 34, as illustrated by dashed lines in FIG. 6A. It would similarly be attached to the first nozzle 34 through the use of the threaded stud 62 and the nut 64.

FIG. 6B is an end view of the illustration in FIG. 6A, showing the second nozzle 36, the trim tab 60, the threaded stud 62, and a nut 64. The trim tab 60 has two surfaces, 67, and 68. If the trim tab is rotated about the centerline of the threaded nut 62 and then rigidly attached by the nut 64, one of these two surfaces, 67 or 68, can be turned to a position against which water will impinge as it passes through the second nozzle 36. As a result, an effective thrust vector toward port or starboard can be created by exposing one of the two surfaces, 67 and 68, to the flow of water passing through the first and second nozzles.

Figure 7:
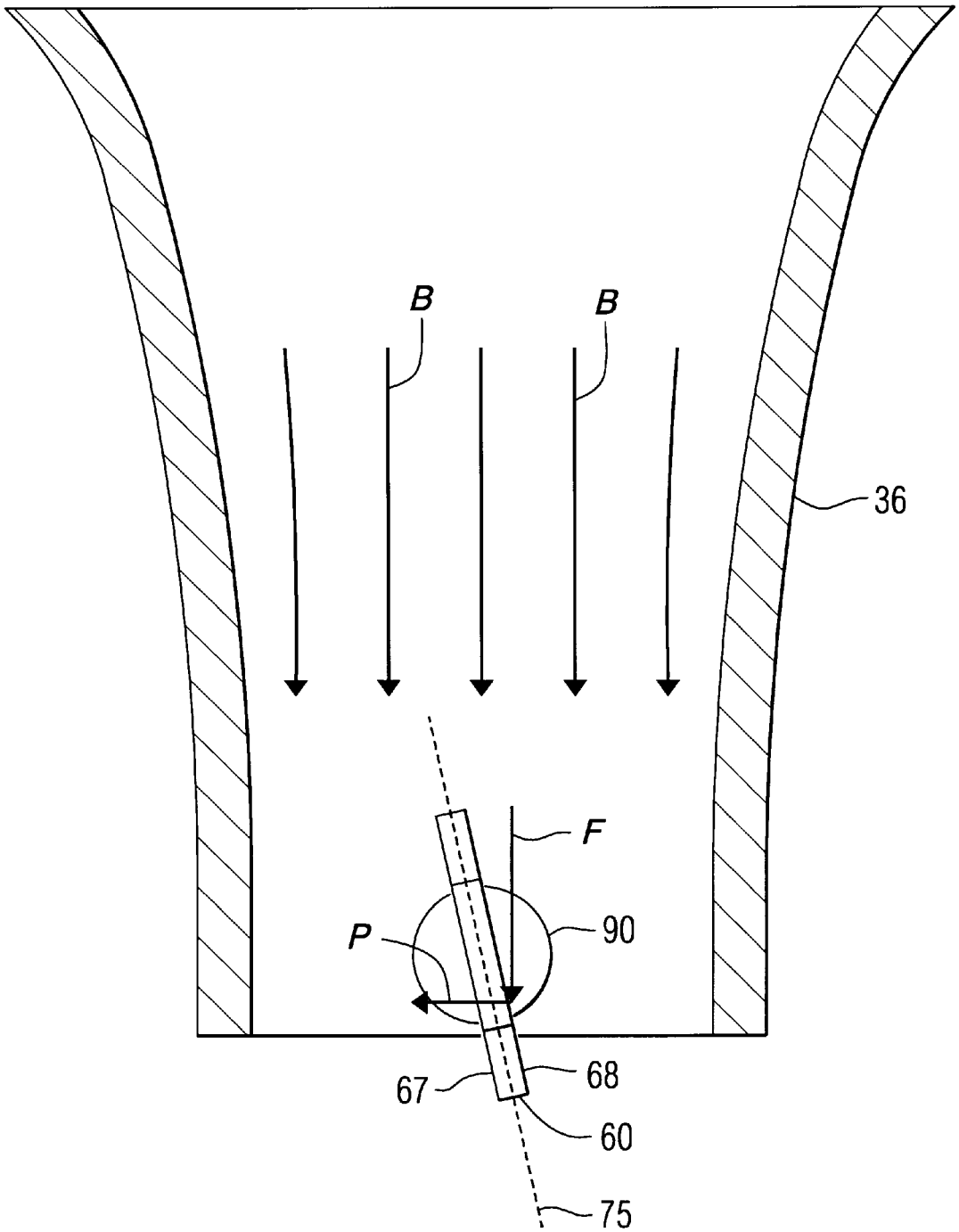
FIG. 7 is a sectional view of a trim tab made in accordance with the present invention.

FIG. 7 is a section view of the second nozzle 36 with a plurality of arrows B representing the direction of water flow as the water is ejected through the first and second nozzles. Arrow F represents a thrust against the surface 68 of the trim tab 60 caused by the water impinging against the surface. An effective thrust vector P, in the port direction, is created by the water impinging against surface 68 of the trim tab 60. Force P is effective as a corrective force when the second nozzle 36 is aligned with the first nozzle 34 and concentrically with horizontal axis 38. Therefore, when the steering mechanism is held in a straight ahead course direction by the operator, force P exerts a corrective thrust in the port direction on the watercraft. It can be seen that the trim tab 60 can be rotated to achieve various angles between the parallel surfaces, 67 and 68, which are represented by dashed line 75, and the direction of water flow which is represented by arrows B.

Although the trim tab 60 in FIGS. 6A and 6B is shown as being attached to the lower internal surface of the second nozzle 36 or, alternatively, to the lower internal surface of the first nozzle 34, it should be understood that the trim tab 60 could also be attached to the upper internal surface of either the first or second nozzle. The same resulting thrust vector P, described above in conjunction with FIG. 7, would result and would provide the same advantageous effect.

Figure 8B:
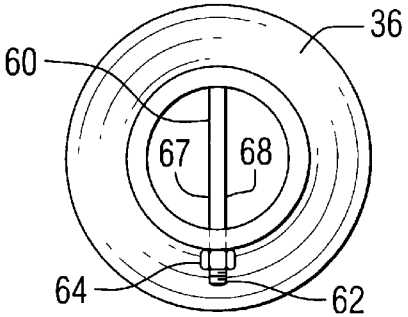
FIGS. 8A and 8B show two views of an alternative embodiment of the present invention.
Figure 8A:
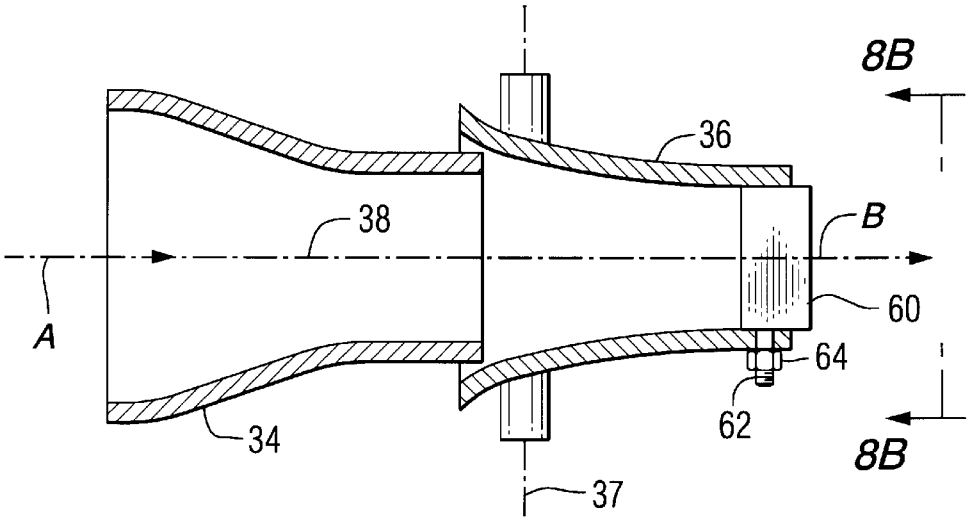

In FIG. 8A, the trim tab 60 extends completely across the diameter of the second nozzle 36. This configuration provides increased surface area on both sides of the trim tab 60. FIG. 8B shows the trim tab 60 aligned with the flow of water. However, it should be understood that in most applications, the trim tab 60 would be rotated about the centerline of the threaded stud 62 to place either of the two surfaces, 67 or 68, in a position which is non-parallel with the central axis 38 of the first nozzle 34. In the position shown in FIG. 8B, no port or starboard thrust would be provided. However, by rotating the trim tab 60 about the centerline of the threaded stud 62, a force vector in either the port or starboard directions can be created.

Figure 9:
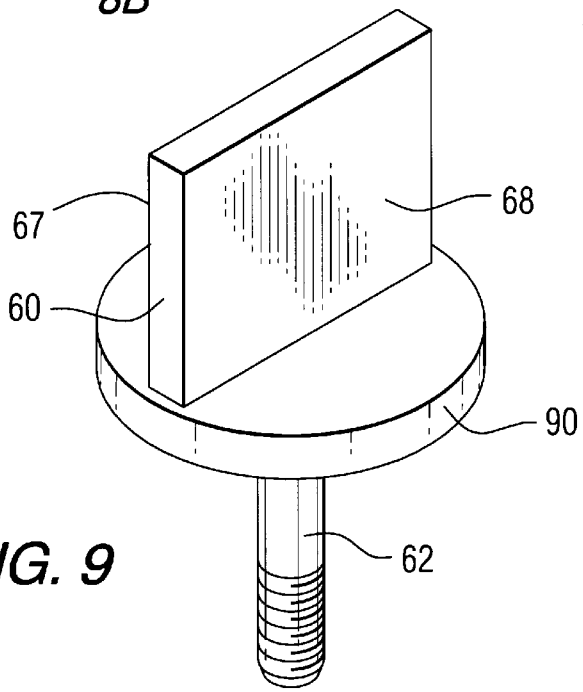
FIG. 9 is an isometric view of a trim tab assembly made in accordance with the present invention.

FIG. 9 is an isometric view of the trim tab 60 attached to a platform 90. Platform 90 is attached to the threaded stud 62 and is rotatable about the centerline of the threaded stud.

It can be seen that the present invention provides a means for creating a corrective force in either the port or starboard direction to, in effect, balance the total net forces on the watercraft when the steering mechanism is in a straight ahead direction. The trim tab can be attached to the bottom or top internal surfaces of either the second nozzle which is rotatable or the first nozzle which is rigidly attached and stationary with respect to the watercraft. The trim tab can extend partially across the diameter of the first or second nozzles, and be attached to either the bottom or top internal surfaces of the nozzles. Alternatively, the trim tab can extend completely across the diameter of the first or second nozzle. It should be understood that although the present invention has been described with particular specificity, many embodiments of the invention are within its scope. The present invention provides a simple way to correct for slight deviations in manufacture or assembly of a jet propulsion system. In addition, the present invention allows existing jet propulsion systems to be quickly and easily modified to adjust for slight steering misalignments. The trim tab of the present invention is also contained in the location which avoids externally protruding elements that can otherwise be dangerous.

I claim:

1. A jet propulsion system for a watercraft, comprising:

a first nozzle through which water is ejected by an impeller, said first nozzle being generally cylindrical and disposed about a horizontal axis;

a second nozzle which is rotatable about a vertical axis through a range of angles relative to said first nozzle; and an adjustable trim tab attached to a preselected one of said first and second nozzles, said trim tab having at least one surface which is disposable in a nonparallel association with said second nozzle, said adjustable trim tab being rigidly attached to an internal surface of said preselected one of said first and second nozzles during operation of said watercraft and being rotatable relative to said preselected one of said first and second nozzles during adjustment of said adjustable trim tab.

2. The jet propulsion system of claim 1, wherein:

said adjustable trim tab is rigidly attached to said second nozzle during operation of said watercraft.

3. The jet propulsion system of claim 2, wherein:

said adjustable trim tab is attached to an internal bottom surface of said second nozzle.

4. The jet propulsion system of claim 2, wherein:

said adjustable trim tab extends vertically from an internal bottom surface of said second nozzle to an internal top surface of said second nozzle.

5. The jet propulsion system of claim 1, wherein:

said trim tab comprises a threaded stud;

said stud extending through a hole through a wall of said preselected one of said first and second nozzles, said adjustable trim tab being rigidly attached by said stud to an internal surface of said preselected one of said first and second nozzles during operation of said watercraft and being rotatable about said stud relative to said preselected one of said first and second nozzles during adjustment of said adjustable trim tab.

6. The jet propulsion system of claim 1, wherein:

said nonparallel association of said at least one surface with a central axis of said second nozzle causes a force to be exerted on said preselected one of said first and second nozzles in a direction which is nonparallel with said central axis.

7. The jet propulsion system of claim 1, further comprising:

a watercraft having said jet propulsion system attached thereto.

8. A jet propulsion system for a watercraft, comprising:

a first nozzle through which water is ejected by an impeller, said first nozzle being generally cylindrical and disposed about a horizontal axis;

a second nozzle which is rotatable about a vertical axis through a range of angles relative to said first nozzle;

an adjustable trim tab rigidly attached to an internal surface of said second nozzle during operation of said watercraft and rotatable relative to said second nozzle during adjustment of said adjustable trim tab, said trim tab having at least one surface which is rotatable relative to said second nozzle, said trim tab comprising a threaded stud, said stud extending through a hole through a wall of said second nozzle; and a watercraft, said first nozzle being attached to said watercraft and said second nozzle being rotatable relative to said watercraft.

9. The jet propulsion system of claim 8,wherein:

said adjustable trim tab is attached to said second nozzle.

10. The jet propulsion system of claim 9,wherein:

said adjustable trim tab is attached to an internal bottom surface of said second nozzle.

11. The jet propulsion system of claim 10, wherein:

said adjustable trim tab extends vertically from an internal bottom surface of said second nozzle to an internal top surface of said second nozzle.

* * * * *